United States Patent [19]

Nishikawa

[11] Patent Number: 5,068,961

[45] Date of Patent: Dec. 3, 1991

[54] METHOD OF MANUFACTURING ION FLOW RECORDING HEAD

[75] Inventor: Masaji Nishikawa, Tokyo, Japan

[73] Assignee: Olympus Optical Co., Ltd., Tokyo, Japan

[21] Appl. No.: 616,337

[22] Filed: Nov. 21, 1990

[30] Foreign Application Priority Data

Nov. 28, 1989 [JP] Japan ..... 1-308476

[51] Int. Cl.[5] ..... H01R 43/00

[52] U.S. Cl. ..... 29/825; 156/901; 174/254; 204/1.11; 346/1.1; 361/414

[58] Field of Search ..... 361/414; 346/1.1, 75; 29/825, 846; 204/15, 11; 156/901, 629; 174/254

[56] References Cited

U.S. PATENT DOCUMENTS 3,689,935 9/1972 Pressman et al. .
4,374,707 2/1983 Pollack ..... 204/11
4,947,184 8/1990 Moynihan ..... 346/1.1
4,972,204 11/1990 Sexton ..... 204/15 X

FOREIGN PATENT DOCUMENTS 61-8424 3/1986 Japan .
2-102071 4/1990 Japan .

*Primary Examiner*—Carl J. Arbes
*Attorney, Agent, or Firm*—Frishauf, Holtz, Goodman & Woodward

[57] ABSTRACT

A method of manufacturing an ion flow recording head of this invention is a method of manufacturing an ion flow recording head which has an ion flow controller in which a first electrode, a first insulating layer, a second electrode, a second insulating layer, and a third electrode are sequentially stacked, and ion flow passage holes are formed in predetermined portions of the multilayered structure. The second electrode is divided into two planar electrodes, i.e., a second-A electrode and a second-B electrode, and the first electrode, the first insulating layer, and the second-A electrode are integrated to constitute a first member. The second-B electrode, the second insulating layer, and the third electrode are integrated to constitute a second member. The first and second members are integrated by adhering the second-A and second-B electrodes to constitute the ion flow controller.

8 Claims, 10 Drawing Sheets

METHOD OF MANUFACTURING ION FLOW RECORDING HEAD

BACKGROUND OF THE INVENTION

1. Field of the Invention

The present invention relates to a method of manufacturing an ion flow recording head, which comprises a corona ion source and an ion flow controller, controls an ion flow generated by the corona ion source by the ion flow controller to obtain a large number of small recording ion flows, and performs desired ion flow recording on a recording medium by these small recording ion flows.

More particularly, the present invention relates to a method of manufacturing an ion flow recording head comprising an ion flow controller in which a first electrode, a first insulating layer, a second electrode, a second insulating layer, and a third electrode are stacked in the order named, two of the first to third electrodes are formed to comprises a plurality of segment electrodes which extend in directions to cross each other, and ion flow passage holes are formed to extend through cross point portions where the electrodes cross each other.

2. Description of the Related Art

A basic arrangement of an ion flow recording head is known to those who are skilled in the art, as disclosed in U.S. Pat. No. 3,689,935. The known ion flow recording head comprises an ion flow controller formed as follows. That is, the ion flow controller has a pair of segment electrodes which oppose each other in a matrix pattern to sandwich a dielectric member formed of an insulating layer therebetween. An ion flow passage hole is formed to extend through a cross point portion where the segment electrodes cross each other. When a voltage to be applied to the pair of segment electrodes is controlled, an ion flow generated by a corona ion source comprising, e.g., a corona wire is controlled, thereby performing desired ion flow recording on an electric charge carrier recording medium such as an electrostatic recording paper sheet.

The ion flow recording head with this structure performs recording by modulating an ion flow flowing through the ion flow passage hole. In addition to the above-mentioned basic structure, an ion flow recording head in which an ion flow passage hole formed in an ion-source side electrode and an insulating layer has a larger diameter than that of an ion flow passage hole formed in an opposite-side electrode and an insulating layer to converge an ion flow, is also known, as disclosed in Published Examined Japanese Patent Application No. 61-8424. The present inventors proposed an ion flow recording head added with a means for converging an ion flow to attain a higher density like in the above-mentioned reference. This head was filed in Japanese Patent Application No. 1-055487 and Japanese Patent Application No. 2-057356 having the former application as a prior application and filed to acquire priority in Japan.

As a means for forming holes in an ion flow controller, a hole working means such as chemical etching, use of a microdrill, use of a punching mechanism, or the like may be applied. However, it is not always easy to apply such a hole working means.

As one notable hole working means, a means for dissolving and removing an insulating layer upon radiation of an excimer laser beam using an electrode pattern as an exposure mask is known, as disclosed in Japanese Patent Application No. 63-255225 previously filed by the present applicant. However, the above-mentioned hole working means can be only marginally satisfactorily applied to a single-layered head material, and it is difficult to apply this means to a multilayered head material in which a large number of insulating layers and a large number of electrode layers are stacked.

The difficulty of application is caused for the following reason. More specifically, in order to obtain segment electrodes, a portion having no electrode members is present between the segment electrodes arranged parallel to each other. Therefore, although ion flow passage holes are to be formed, when an excimer laser beam is radiated on an insulating layer in a gap portion where no electrode members are present, holes are undesirably formed in this portion. In order to prevent this, the gap portion between the electrodes, i.e., a portion where the insulating layer is exposed must be satisfactorily masked by a mask member. However, it is very difficult to precisely mask the micropatterned gap portion in practice.

As examples of multilayered structures in which respective layers are patterned, semiconductor circuit elements, multilayered printed circuit boards, and the like are known. However, there are nearly no examples having a unique pattern and structure, i.e., in which through holes locally have different diameters, and the opening diameters fall within a range of several tens of microns to several hundreds of microns upon completion of a structure like in an ion flow controller. Therefore, in the manufacture of an ion flow recording head having the above-mentioned structure, even if conventional working methods are combined, it is almost impossible to directly apply these methods. Therefore, a conventional inefficient working method must be employed. For this reason, an ion flow controller cannot be efficiently manufactured, thus preventing realization of an ion flow recording head, in particular, a high-speed ion flow recording head. In addition, it is difficult to reduce cost.

SUMMARY OF THE INVENTION

It is an object of the present invention to provide a method of manufacturing an ion flow recording head, which allows working using a excimer laser hole working technique or another working technique, can easily and precisely form ion flow passage holes, and allows easy manufacture of a inexpensive high-speed ion flow recording head.

In order to achieve the above object, the present invention adopts the following means (1) to (8).

(1) There is provided a method of manufacturing an ion flow recording head which controls, to obtain a large number of small recording ion flows, an ion flow generated by a corona ion source by an ion flow controller, in which a first electrode, a first insulating layer, a second electrode, a second insulating layer, and a third electrode are sequentially stacked, the first and third electrodes are formed to comprise a plurality of segment electrodes extending in directions to cross each other, and ion flow passage holes are formed to extend through cross point portions where the first and second electrodes of the multilayered structure cross each other, wherein the second electrode is divided into two planar electrodes, i.e., second-A and second-B electrodes, the first electrodes, the first insulating layer, and the second-A electrodes are integrated to constitute a first member, the second-B electrode, the second insulating layer, and the third electrodes are integrated to constitute a second member, and the second-A and second-B electrodes are joined to integrate the first and second members, thereby constituting the ion flow controller.

(2) The following means is added to the means (1). An excimer laser beam is radiated on the first and second members using, as exposure masks, the second-A and second-B electrodes in which holes are formed in advance thereby forming ion flow passage holes in the respective members.

(3) The following means is added to the means (1). Each ion passage hole formed in the first member is formed to have a hole diameter equal to or larger than that of each ion flow passage hole formed in the second member.

(4) The following means is added to the means (1). Each ion flow passage hole formed in the first insulating layer and the second-A electrode of the first member is formed to have a hole diameter larger than that of each ion flow passage hole formed in the first electrodes.

(5) The following means is added to the means (1). Each ion flow passage hole formed in the first insulating layer and the second-A electrode in the first member is formed as a strip-like opening portion having a size large enough to include a plurality of unit pixel ion flow passage holes. (6) There is also provided a method of manufacturing an ion flow recording head which controls, to obtain a large number of small recording ion flows, an ion flow generated by a corona ion source by an ion flow controller, in which a first electrode, a first insulating layer, a second electrode, a second insulating layer, and a third electrode are sequentially stacked, two of the first to third electrodes are formed to comprise a plurality of segment electrodes extending in directions to cross each other, and ion flow passage holes are formed to extend through cross point portions where the two electrodes cross each other, so that the ion flow passage holes formed to extend through the first electrode opposing the ion source, and the first insulating layer have a larger diameter than that of the ion flow through holes formed to extend from the second electrode to the third electrode, wherein the first electrode and the first insulating layer are integrated, the ion flow passage holes are formed in this integrated structure, and an adhesion layer is formed on the surface of the first insulating layer to constitute a first structure, the second electrode, the second insulating layer, and the third electrode are integrated, and the ion flow through holes are formed in this integrated structure to constitute a second structure, and the adhesion layer and the second electrode are joined to integrate the first and second structures, thereby forming the ion flow controller.

(7) The following means is added to the means (6). After a hot-melt adhesive is applied on the first insulating layer and is dried, the ion flow passage holes are simultaneously formed to extend through the first insulating layer and the hot-melt adhesive layer, thus forming the first structure.

(8) The following means is added to the means (6). The first electrode, the first insulating layer, and the hot-melt adhesive layer are integrated, and holes are formed in the first electrode. Thereafter, an excimer laser beam is radiated on the resultant structure from the first electrode side, thereby forming the ion flow passage holes to extend through the first insulating layer and the hot-melt adhesive layer.

Since the means (1) to (8) are adopted, the following effects (1) to (8) are obtained.

(1) Since the first and second members as units of hole working independently exist in the middle of a process, they can be independently worked. Therefore, a hole working operation is easy, and holes can be precisely formed.

(2) The entire surfaces of the second-A and second-B electrodes have patterns defining planar electrode surfaces excluding portions of the unit pixel ion flow passage holes. Therefore, the second-A and second-B electrodes are used as masking members, and an excimer laser beam can be radiated from the side of these electrodes, thus allowing easy and precise hole working. As a result, neither special mask plate for hole working using an excimer laser beam nor alignment for precisely aligning the mask plate and a structure to be worked are required. Therefore, a troublesome work operation can be eliminated.

(3) Whether or not the ion flow controller has an ion flow convergence function can be arbitrarily determined depending on how to select the diameter of the ion flow passage holes of the first member with respect to that of the second member.

(4) The diameter of the ion flow passage holes formed in the first insulating layer and the second-A electrode is larger than that of the ion flow passage holes formed in the first electrode. For this reason, even if the adhesive projects to an adhered surface between the first and second members, the projecting adhesive does not influence the diameter of the ion flow determined by the diameter of each ion flow passage hole of the first electrode. That is, the projecting adhesive will not disturb passage of the ion flow. Therefore, an adhesion process can be simplified.

(5) Since the shape of each ion flow passage hole formed in the first insulating layer and the second-A electrode can be simplified, easy manufacture is allowed.

(6) The first and second structures can be relatively easily formed by a means such as etching, punching, excimer laser process, and the like. In addition, the last multilayered structure completion process is an adhesion process, and no hole working is performed at all. Therefore, there is no obstacle in the manufacture. Even when an adhesive slightly projects into the through holes formed in the first insulating layer, the through holes are formed to have a large diameter in advance, and the projecting adhesive does not significantly influence operations and effects of the ion flow recording head.

(7) When holes are formed in the first insulating layer, an adhesive is simultaneously removed by the hole working process. For this reason, projection of the adhesive into the ion flow passage holes can be almost completely prevented.

(8) Since the first electrode is used as a masking member and a hole working process is performed by an excimer laser beam, a plastic sheet to which a precision working technique is difficult to apply can be efficiently and precisely worked while completely preventing an adhesive from projecting into holes of the first insulating layer.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1 to 10 show the first embodiment of the present invention, in which FIG. 1 is a schematic diagram showing an arrangement of an ion flow recording head, FIGS. 2 to 5 are plan views showing patterns of first to third electrodes, respectively, FIG. 6 is a plan view showing a modification of the first electrode, FIG. 7 is a view showing steps in the manufacture of first and second members, FIG. 8 is a diagram showing a hole working means using an excimer laser beam, FIG. 9 is a view showing a method of manufacturing an ion flow controller by adhering the first and second members, and FIG. 10 is a sectional view showing the ion flow controller manufactured by the method shown in FIG. 9;

FIGS. 12 to 14 show the third embodiment of the present invention, in which FIG. 12 is a sectional view showing a structure of an ion flow controller, FIG. 13 is a plan view showing the relationship between hole diameters of ion flow passage holes in a first electrode and a first insulating layer of a first member, and FIG. 14 is a plan view showing a modification of FIG. 13;

FIGS. 15 to 22 show the fourth embodiment of the present invention, in which FIG. 15 is a schematic diagram showing an arrangement of an ion flow recording head, FIGS. 16 to 19 are plan views showing patterns of first to third electrodes, FIG. 20 is a view showing a manufacturing method of an ion flow controller of the fourth embodiment, FIG. 21 is a sectional view showing the ion flow controller manufactured by the method shown in FIG. 20, and FIG. 22 is a sectional view showing a means for removing an adhesive projecting portion of the ion flow controller manufactured by the method shown in FIG. 20;

FIGS. 25 to 28 show the seventh embodiment of the present invention, in which FIG. 25 is a schematic diagram showing an arrangement of an ion flow recording head of this embodiment, and FIGS. 26 to 28 are plan views showing patterns of first to third electrodes in an ion flow controller shown in FIG. 25.

DETAILED DESCRIPTION OF THE PREFERRED EMBODIMENTS

First Embodiment

The first embodiment of the present invention will be described below with reference to FIGS. 1 to 10.

Figure 1:
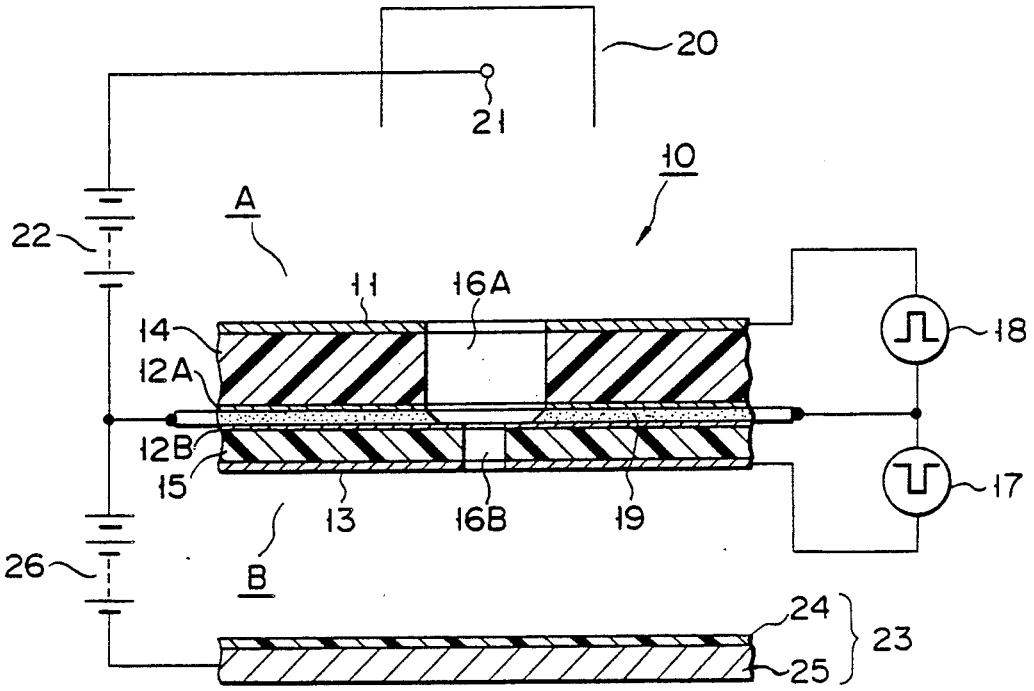

FIG. 1 shows an arrangement of an ion flow recording head comprising an ion flow controller manufactured by adopting a manufacturing method of the present invention. As shown in FIG. 1, an ion flow controller 10 is constituted by sequentially stacking first electrodes 11, a first insulating layer 14, a second-A electrode 12A, an adhesive layer 19, a second-B electrode 12B, a second insulating layer 15, and third electrodes 13.

It should be noted that a second electrode is divided into two planar electrodes, i.e., the second-A electrode 12A and the second-B electrode 12B. The second-A and second-B electrodes 12A and 12B are simultaneously connected to each other in an external portion to be kept at the same potential.

Large-diameter first ion flow passage holes 16A are formed in a portion consisting of the first electrodes 11, the first insulating layer 14, and the second-A electrode 12A, i.e., a first member A. Small-diameter second ion flow passage holes 16B are formed in a portion consisting of the second-B electrode 12B, the second insulating layer 15, and the third electrodes 13, i.e., a second member B.

FIGS. 2 to 5 are plan views showing patterns of the first to third electrodes 11 to 13 of the ion flow controller 10 shown in FIG. 1. In these figures, the ion flow passage holes 16A and 16B are aligned in a two-dimensional matrix.

Figure 2:
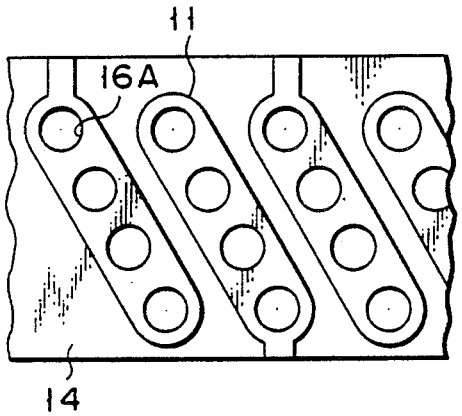

As shown in FIG. 2, the first electrodes 11 are formed as segment electrodes for coupling the ion flow passage holes 16A in the vertical direction of the drawing and segmenting them in the horizontal direction thereof.

Figure 3:
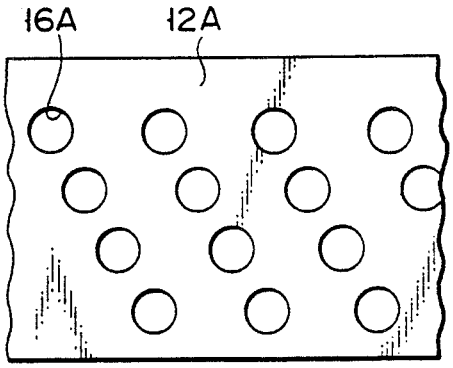

As shown in FIG. 3, the second-A electrode 12A is a solid electrode, and only through holes serving as the ion flow passage holes 16A are formed. That is, no special pattern is formed on the electrodes 12A and 12B.

Figure 4:
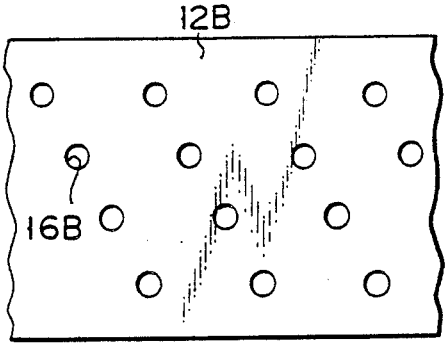

As shown in FIG. 4, the second-B electrode 12B is similarly a solid electrode. Through holes having a relatively small diameter and serving as the ion flow passage holes 16B are formed in this electrode 12B.

Figure 5:
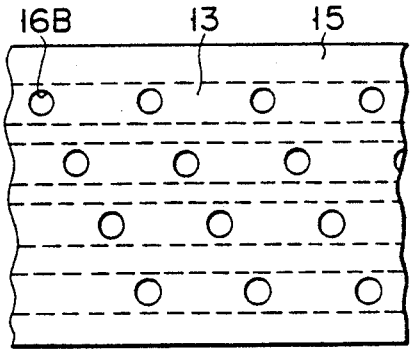

As shown in FIG. 5, the third electrodes 13 are formed as segment electrodes for coupling the ion flow passage holes 16B in the horizontal direction of the drawing, and segmenting them in the vertical direction thereof.

In this manner, signal voltages can be applied from the first and third electrodes 11 and 13 to the ion flow passage holes arranged in a matrix upon two-dimensional selection. When signal voltages in a direction to allow passage of an ion flow are simultaneously applied to both the first and third electrodes 11 and 13, only the ion flow passage holes corresponding to portions where these electrodes cross each other allow an ion flow to pass therethrough.

Figure 6:
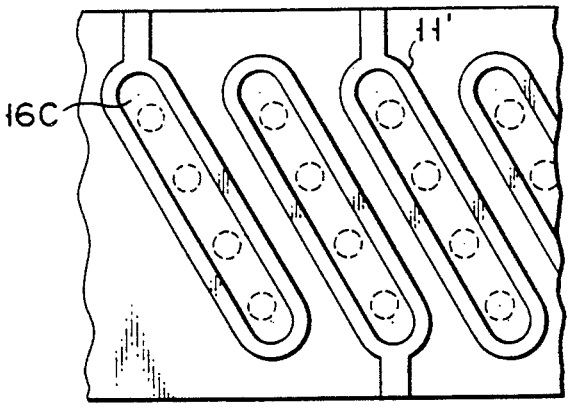

FIG. 6 shows a modification of the first electrodes 11. Each first electrode 11' has an ion flow passage hole 16C as an elongated slit-like hole. When the ion flow passage hole is formed to have this pattern, a working process can be facilitated. Note that the function of the first electrodes 11' corresponds to that shown in FIG. 2.

Referring back to FIG. 1, reference numeral 17 denotes a signal source for forming a recording image; and 18, a power source for forming an ion flow convergence electric field. Reference numeral 20 denotes an ion source, such as a corotron charger, for generating corona ions. The ion source 20 comprises a corona wire 21 in its central portion. Reference numeral 22 denotes a high-voltage power source for generating corona ions; and 23, a recording medium. The recording medium 23 comprises an insulating layer 24 and a conductive support 25. Reference numeral 26 denotes a bias power source for the recording medium. The bias power source 26 forms a bias electric field for preventing ion flows radiated from the passage holes 16B of the ion flow controller 10 toward the recording medium 23 from being diffused during radiation.

Note that the ion flow passage holes 16A are through holes serving both to converge an ion flow and to ON/-OFF-control the ion flow. The ion flow passage holes 16A have a larger diameter than that of the ion flow passage holes 16B extending from the second electrodes 12 to the third electrode 13 so as to collect an ion flow from the ion source 20 in a wider range and to send them into the next ion flow passage holes 16B. The ion flow passage holes 16B are ion flow control through holes which can also ON/OFF-control the received ion flow.

FIGS. 7 to 10 show a method of manufacturing the ion flow controller 10 comprising the multilayered structure, as shown in FIG. 1.

Figure 7:
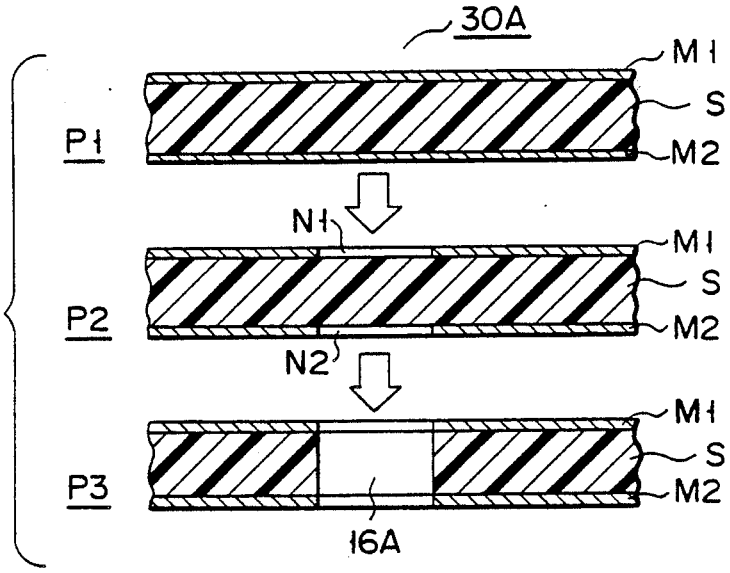

FIG. 7 shows a method of working the first and second members A and B with reference to the first member A. In process P1, a member 30A is prepared by forming metal thin films M1 and M2 on two surfaces of an insulating sheet S formed of, e.g., a polyimide resin. In process P2, holes for forming the first and second-A electrodes 11 and 12A are formed in the metal thin films M1 and M2 on the member 30A. That is, holes N1 and N2 are formed. At this time, the holes N1 and N2 are formed in regions of the metal thin films M1 and M2 as electrode materials in correspondence with the ion flow through holes. However, no holes are formed in the corresponding regions of the insulating sheet S. In process P3, holes are formed in the insulating sheet S. That is, the holes 16A are formed.

Figure 8:
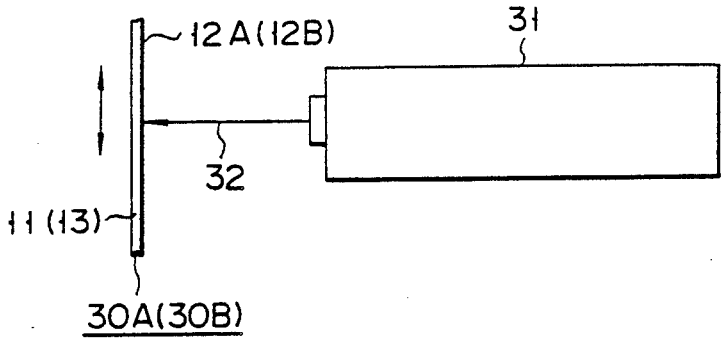

FIG. 8 shows a working means for the holes 16A. A laser beam 32 emitted from an excimer laser beam radiation device 31 is radiated on the intermediately worked member 30A from the side of the second-A electrode 12A. Thus, openings, i.e., the ion flow passage holes 16A are formed in the insulating sheet S. That is, the excimer laser beam 32 acts not on the metal member, but on a polymer compound as a material of the insulating sheet S. For this reason, holes having the same diameter as the holes N1 formed in the second-A electrode 12A are formed in the insulating sheet S. As a result, a hole working process can be performed using the electrode 12A as a mask member.

Holes are formed in the second member B in the same process as described above. In FIG. 8, reference numeral 30B denotes a member for forming the second member; 12B, the second-B electrode; and 13, the third electrodes.

Note that regions where the insulating sheet S is exposed are present on the opposing surface of each of the members 30A and 30B in addition to the formation regions of the ion flow passage holes. More specifically, insulating regions for isolating the electrodes are present between the plurality of first segment electrodes 11 and between the plurality of third segment electrodes 13. Therefore, if a laser beam is radiated on these regions, holes are undesirably formed in these regions. As described above, however, such formation of holes can be prevented since this embodiment employs the method described with reference to FIG. 8.

The first and second members obtained through these processes are adhered and integrated by an adhesive.

Figure 9:
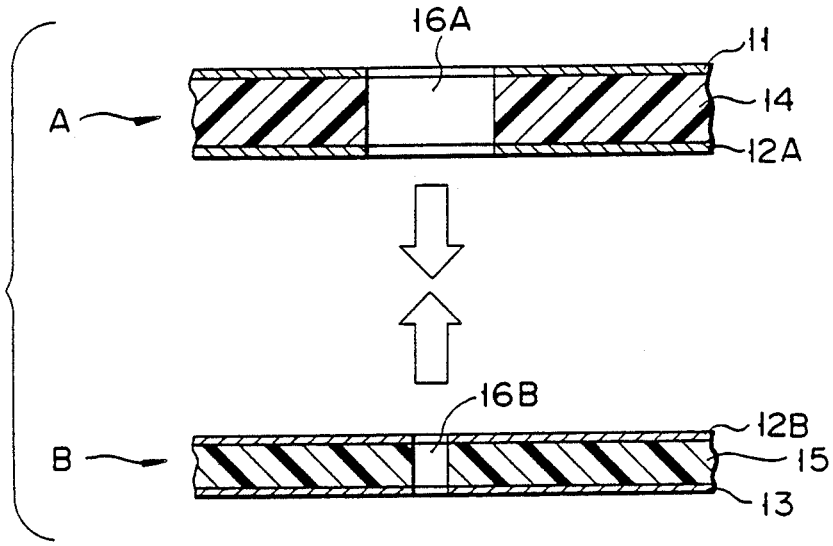

More specifically, as shown in FIG. 9, the first member A obtained by integrating the first electrodes 11, the first insulating layer 14, and the second-A electrode 12, and the second member B obtained by integrating the second-B electrode 12B, the second insulating layer 15, and the third electrodes 13 are arranged to oppose each other. An adhesive is applied on adhesion surfaces of the first and second members A and B, and the first and second members A and B are pressed, as indicated by hollow allows, thereby adhering these members. Thus, these members can be integrated.

Figure 10:
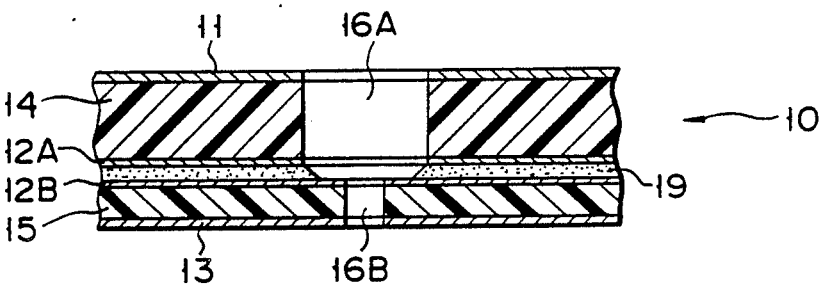

In this manner, the ion flow controller 10 is completed, as shown in FIG. 10. Note that reference numeral 19 denotes the adhesive layer.

When the adhesive layer 19 is thin, the electrodes 12A and 12B are electrically connected to each other even if no special countermeasure is taken. In order to assure electrical connection, it is preferable that lead wires of the two electrodes are externally connected to each other, as shown in FIG. 1. The two electrodes may be directly soldered to each other.

The ion flow recording head of the first embodiment with the above-mentioned structure has the following functions. An ion flow flying from the above in FIG. 1 toward the ion flow controller 10 flows along lines of electric force formed in the ion flow passage holes 16A and portions around them by the first and second-A electrodes 11 and 12A.

When a voltage is applied in a direction (polarity) to promote entrance of an ion flow, an ion flow in a region wider than the diameter of the ion flow passage holes 16A on the side of the ion source 20 is collected in the ion flow passage holes 16A, and is guided inside the holes 16A. The ion flow guided inside the ion flow passage holes 16A is guided to the ion flow passage holes 16B on the opposite side. The ion flow is converted into an ion flow having a high ion density, and travels toward the recording medium 23.

When a voltage is applied in a direction (polarity) to block entrance of an ion flow, an ion flow is guided toward an electrode surface outside the ion flow passage holes 16A. That is, entrance of the ion flow into the ion flow passage holes 16A is blocked.

The second-A and second-B electrodes 12A and 12 ON/OFF control the converged ion flow, i.e., determine whether or not the ion flow is allowed to pass through the holes toward the recording medium 23 placed in a lower position in FIG. 1, or control a passage ion flow rate.

In the first embodiment, since the first and second members A and B are independently manufactured, the hole working process is easy. Since the ion flow passage holes 16A and 16B can be worked with high precision, an ion flow control operation can be stably and precisely performed. As a result, good recording characteristics can be expected.

Second Embodiment

Figure 11:
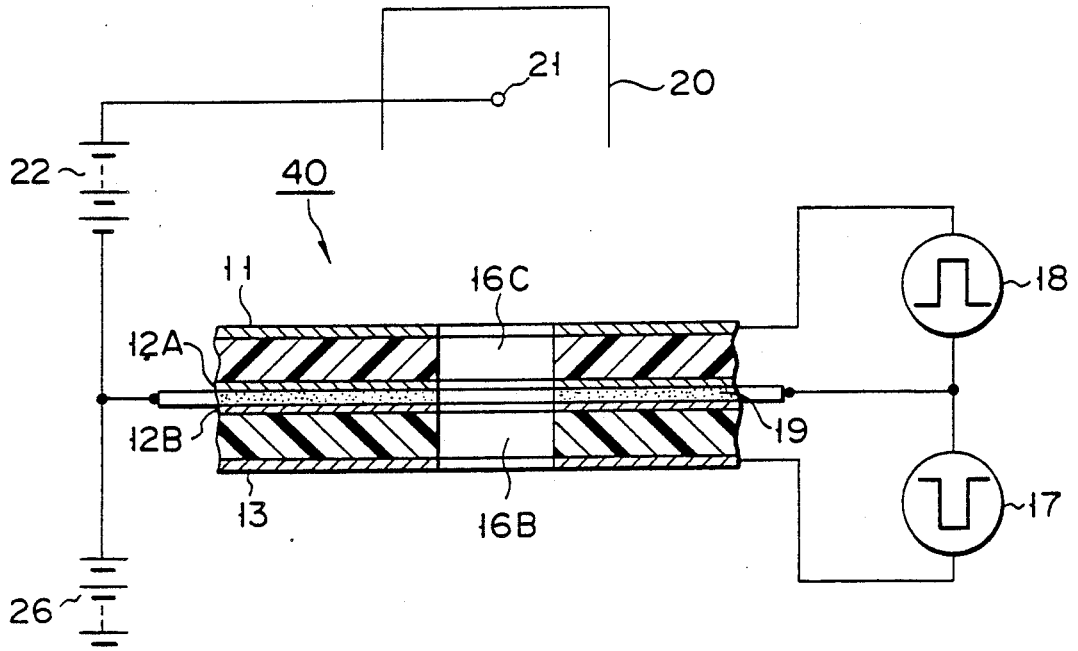
FIG. 11 is a schematic diagram showing an arrangement of an ion flow recording head according to the second embodiment of the present invention.

FIG. 11 shows the second embodiment of the present invention. An ion flow controller 40 of this embodiment comprises ion flow passage holes 16C having the same diameter as ion flow passage holes 16B in place of the large-diameter ion flow passage holes 16A of the ion flow controller 10 shown in FIG. 1. More specifically, the ion flow controller 40 basically has no ion flow convergence function. The ion flow controller 40 of this embodiment can be manufactured following the same procedures as in the first embodiment. Therefore, the ion flow controller 40 can provide the same operations and effects as in the first embodiment.

In the manufacture of the ion flow controller 10 or 40 shown in FIG. 1 or 11, when the first and second members A and B are adhered by an adhesive, the adhesive may project from the adhesion surfaces. When the adhesive considerably projects into the ion flow passage holes, ion flow control characteristics are changed. As a result, a recorded image may suffer from density non-uniformity.

Third Embodiment

Figure 12:
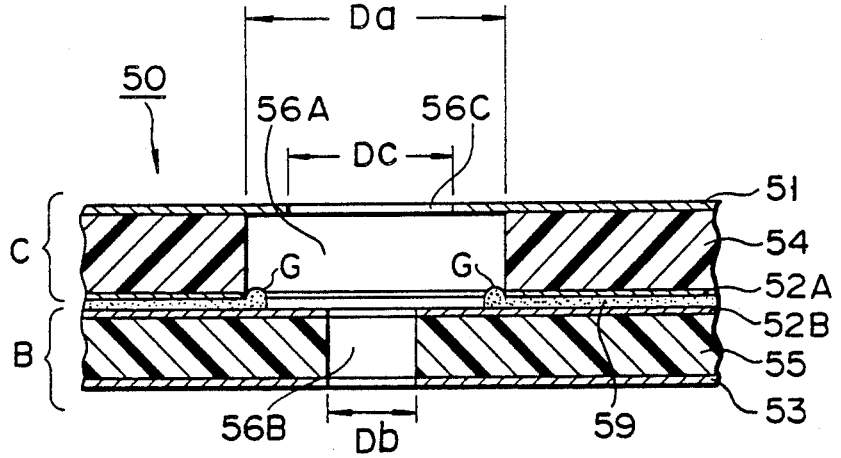

FIG. 12 shows the third embodiment of the present invention, which provides an improvement to eliminate the above-mentioned drawback. An ion flow controller 50 shown in FIG. 12 comprises first electrodes 51, a second-A electrode 52A, a second-B electrode 52B, third electrodes 53, a first insulating layer 54, a second insulating layer 55, an adhesive layer 59, and the like. Reference numeral 56A denotes ion flow passage holes formed in the first insulating layer 5 and the second-A electrode 52A; 56B, ion flow passage holes formed in the second-B electrode 52B and the second insulating layer 55; and 56C, ion flow passage holes formed in the first electrodes 51.

As shown in FIG. 12, a diameter Da of each ion flow passage hole 56A formed in the first insulating layer 54 and the second-A electrode 52A is larger than a diameter Dc of each ion flow passage hole 56C formed in each first electrode 51. As a method of forming these holes, when a modified first member C in the ion flow controller 50 is manufactured, an excimer laser beam is radiated using the second-A electrode 52A as a masking member, thereby forming the ion flow passage holes 56A having a larger diameter than that of the ion flow passage holes 56C of the first electrodes 51.

When an adhesive is applied on the surface of the second-A electrode 52A of the modified first member C which is worked as described above, and the member C is adhered to a second member B, a projecting portion G of the adhesive may be formed, as shown in FIG. 12.

In the third embodiment, however, the projecting portion G of the adhesive is present at a position falling outside an ion flow path (a path extending from each ion flow passage hole 56C having a large-diameter opening Dc of each first electrode 51 to the corresponding ion flow passage hole 56B having a small-diameter opening Db of the second member B). For this reason, the projecting portion G will not adversely influence the function of the ion flow controller 50.

Figure 13:
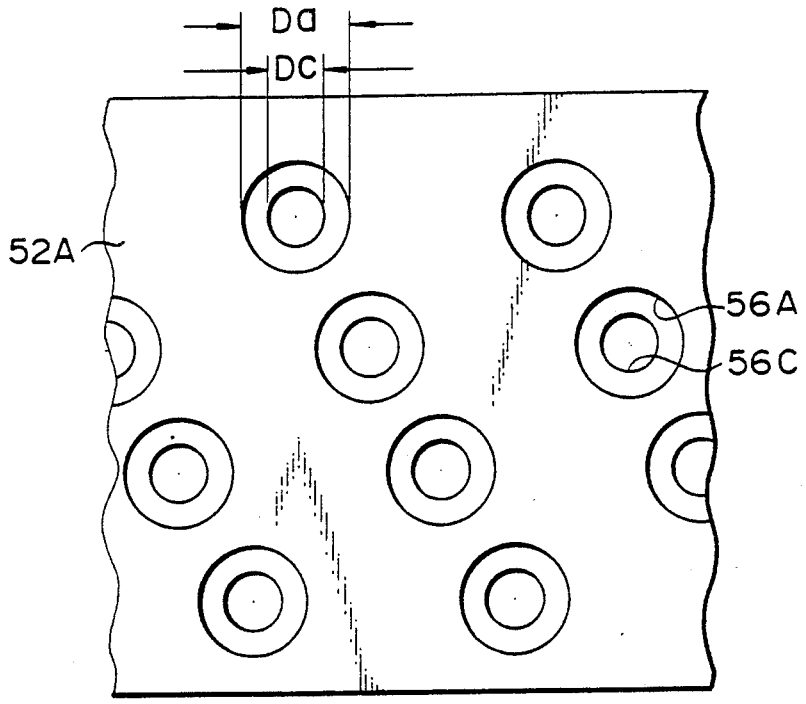

FIG. 13 is a plan view when the modified first member C is viewed from the side of the second-A electrode 52A. FIG. 13 shows the relationship among the pattern of the electrode 52A, the ion flow passage holes 56A formed in the first insulating layer 54, and the ion flow passage holes 56C formed in the first electrodes 51. As shown in FIG. 13, each ion flow passage hole 56A formed in the second-A electrode 52A and the first insulating layer 54 has an independent circular pattern in one-to-one correspondence with the unit pixel ion flow passage holes 56C. However, the ion flow passage holes 56A need not always have the above-mentioned pattern.

Figure 14:
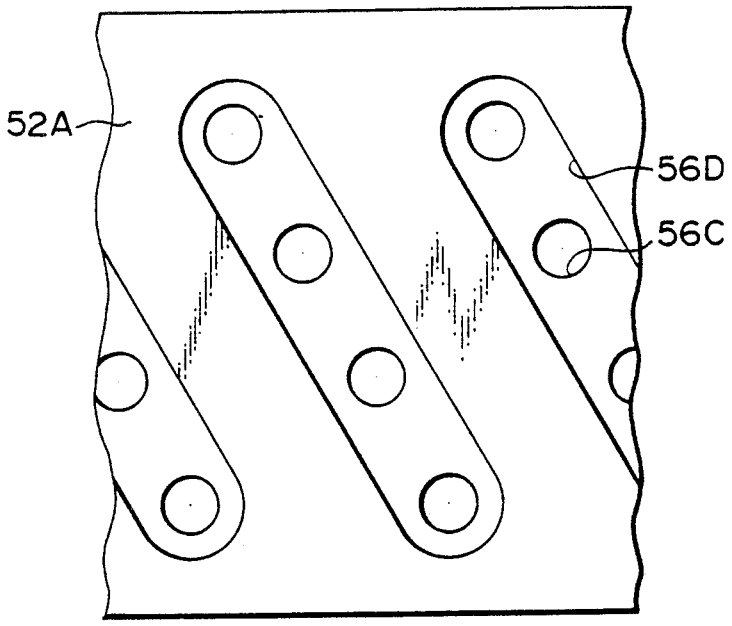

FIG. 14 shows a modification of the holes. FIG. 14 exemplifies a case wherein segment openings 56D having a size large enough to include a plurality of unit pixel ion flow passage holes 56C are formed in place of the ion flow passage holes 56A.

Fourth Embodiment

Figure 15:
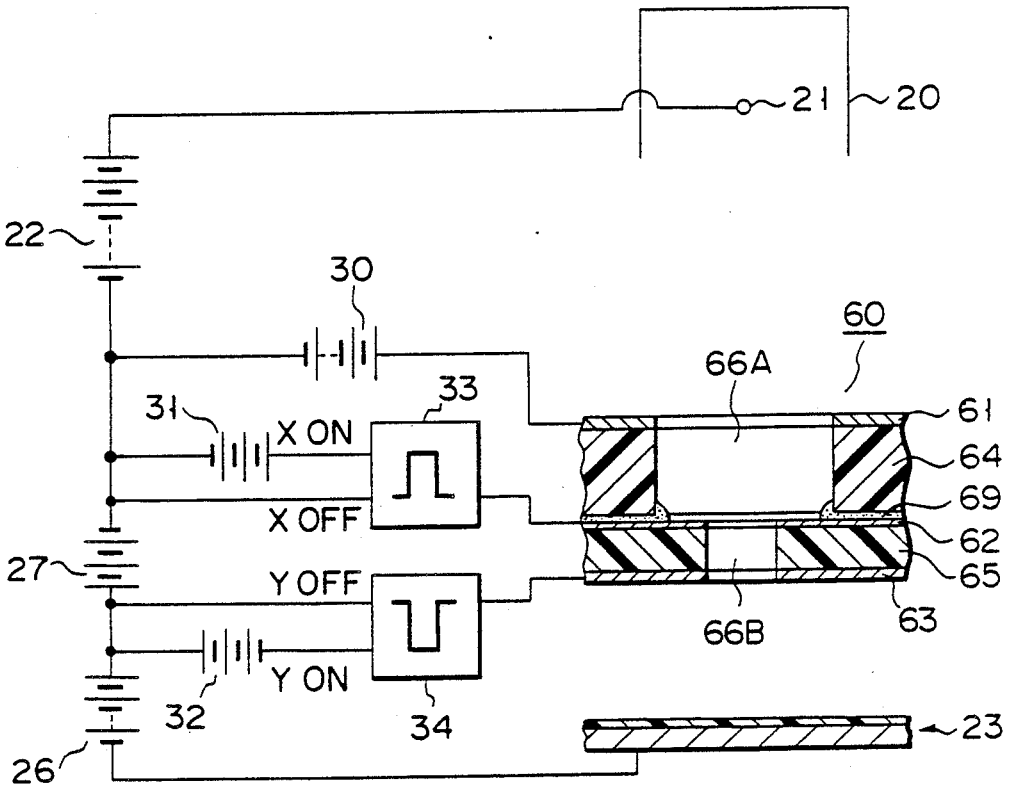

FIG. 15 shows the fourth embodiment of the present invention. An ion flow controller 60 comprises a first electrode 61, a first insulating layer 64, second electrodes 62, a second insulating layer 65, third electrodes 63, first ion flow passage holes 66A, second ion flow passage holes 66B, and an adhesive layer 69. The ion flow controller 60 has substantially the same structures as that shown in FIG. 1 together with an ion source 20, a recording medium 23, power sources 22 and 26, and the like. However, the first electrode 61 of the ion flow controller 60 is a solid electrode. The second and third electrodes 62 and 63 comprise a plurality of segment electrodes which are segmented in directions perpendicular to each other. Through holes corresponding to the ion flow passage holes 66A and 66B are formed in cross points of the electrodes. Reference numeral 27 denotes an ion flow passage blocking bias power source; 30, an ion flow convergence power source; 31 and 32, ion flow passage promoting bias power sources; and 33 and 34, switching circuits.

Figure 16:
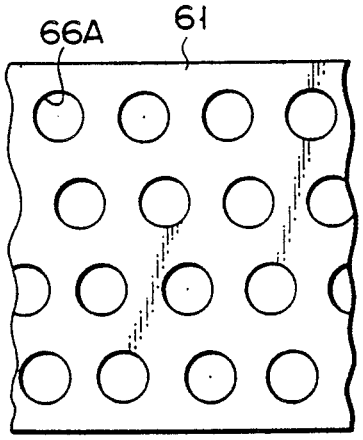
Figure 17:
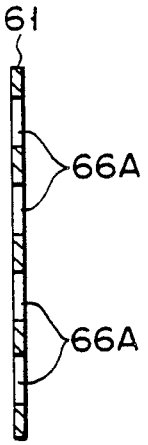
Figure 18:
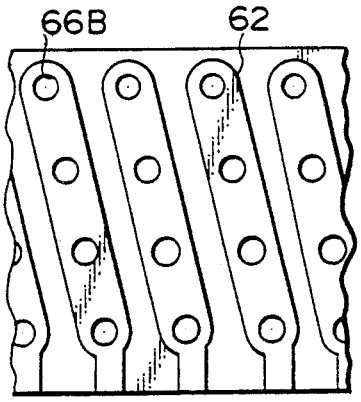
Figure 19:
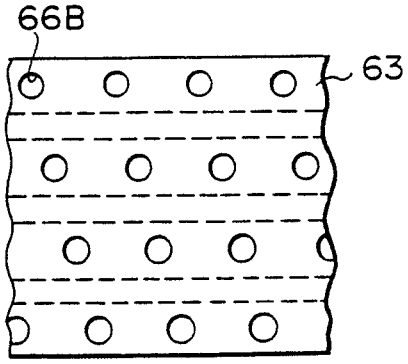

FIGS. 16 to 19 are plan views of the electrodes of the ion flow controller 60 shown in FIG. 15. FIG. 16 is a plan view of the first electrode 61, FIG. 17 is a side sectional view of FIG. 16, FIG. 18 is a plan view of the second electrodes 62, and FIG. 19 is a plan view of the third electrodes 63.

The ion flow controller 60 is manufactured as follows.

Figure 20:
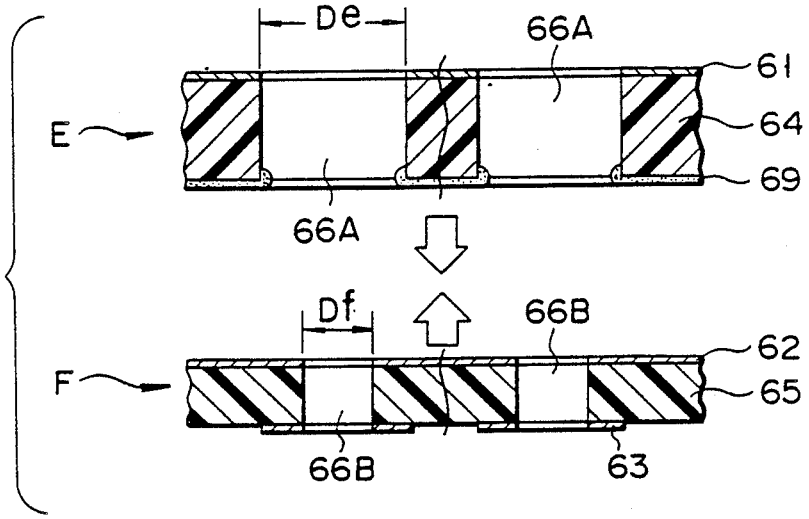
Figure 21:
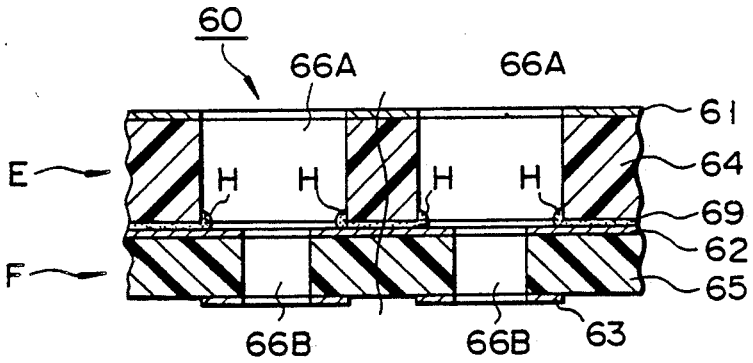

FIGS. 20 and 21 show a method of manufacturing the ion flow controller 60. Note that FIGS. 20 and 21 illustrate sections in a direction perpendicular to the segment electrodes. In FIGS. 20 and 21, a line partitioning the central portion of each figure to right and left portions represents that the right and left structures are cut at different positions.

A first structure E is manufactured first. A member is prepared by forming a metal foil film such as copper, nickel, or the like for constituting the first electrode 61 on one surface of a high-insulating substrate such as polyimide for constituting the first insulating layer 64

This member may be prepared by adhering the metal foil film using an adhesive or by depositing the metal foil film by means of, e.g., sputtering. It is preferable that such members are selectively used depending on hole working methods of the first insulating layer 64.

More specifically, when holes are formed in the first insulating layer 64 by punching o radiation of an excimer laser beam, a member prepared by adhering the metal foil film using a adhesive is preferably used.

On the other hand, when holes are formed in the first insulating layer 64 by chemical etching, a member prepared by depositing the metal foil film by, e.g., sputtering (i.e., a method using no adhesive) is preferably used.

A procedure for forming the large-diameter ion flow passage holes 66A in the electrode and the insulating layer of the member prepared as described above is carried out by, e.g., one of the following two processes (a) and (b).

(a) The member is placed on an NC work table, and a pin and a dice for punching are set. A punching process is then performed while moving the member at a predetermined pitch, thus forming predetermined holes.

(b) A photoresist is coated on a surface of a metal foil film, and a master plate having a hole working pattern is overlaid thereon. Ultraviolet rays are then radiated to set the photoresist in accordance with the pattern. Thereafter, unexposed portions are removed by washing, and an etching solution for removing a metal acts on the member. In this manner, the metal foil film portions corresponding to the through hole portions are removed, thus forming a solid electrode. A chemical etching solution for dissolving polyimide acts from the side of the electrode using the solid electrode as a mask.

In this manner, the through holes 64A are formed in the layers 61 and 64, as shown in FIG. 20.

The adhesive layer 69 is applied on the surface (lower surface in FIG. 20) of the first insulating layer 64. As an adhesive any types of adhesive, such as a two-part reactive set type adhesive, a heat polymerization set type adhesive, a hot-melt type adhesive, and the like may be used.

When the first electrode 61 is formed of a metal having a poor corrosion resistance such as a copper foil, nickel plating or gold plating is preferably performed on its surface. This plating is preferably performed before the adhesive application process.

In this manner, the first structure E having the section shown in FIG. 20 is completed. Note that preferable dimensions of the respective portions used when a recording head having a print dot density of 200 to 400 DPI are as follows:

Thickness of First Insulating Layer 64 . . . several tens to several hundreds of μm Thickness of First Electrode 61 . . . 1 to 10 μm Diameter of Through Hole 64A . . . 100 to several hundreds of μm Thickness of Adhesive Layer 69 . . . several μm to between 10 to 20 μm A method of manufacturing a second structure F will be described below.

A member is prepared by forming metal foil films for forming the second and third electrodes 62 and 63 on two surfaces of a high-insulating sheet such as polyimide. Whether a member prepared by adhering separately formed metal foil films on the high-insulating sheet using an adhesive or a member prepared by forming metal foil films by deposition using sputtering without using an adhesive is used as the member depends on whether or not holes are formed in the polyimide insulating layer by chemical etching, as described above.

Process Example

The second and third electrodes 62 and 63 are etched to form holes.

Process Example 1

This process example employs an all-etching process. More specifically, metal film portions corresponding to portions of the through holes is removed by etching (first step). Then, a polyimide etching solution is caused to act on two surfaces, thus forming through holes. Then, segment patterns of the second and third electrodes 62 and 63 are formed by a metal etching method.

Process Example 2'

In this example, holes are formed in the polyimide insulating layer by an excimer laser beam. More specifically, metal film portions corresponding to through hole portions are removed by metal etching (first step). Then, an excimer laser beam is radiated from one surface side to photochemically decompose and remove the polyimide layer and the adhesive layer, thus forming through holes. Furthermore, the second and third electrodes 62 and 63 are segmented by a metal etching method. Preferable dimensions of the respective portions are as follows:

Thickness of Second Insulating Layer . . . several tens of μm to between 100 to 200 μm Thickness of Section and Third Electrodes . . . 1 to 10 μm Diameter of Ion Flow Passage holes . . . 50 to 200 μm Note that a ratio De/Df of a diameter De of each ion flow passage hole 66 A of the first structure E to a diameter Df of each ion flow passage hole 66B of the second structure F is preferably set to fall within a range of 1.5 to 2.0.

The first and second structures E and F prepared in this manner are adhered and integrated, as shown in FIG. 21.

The two structures E and F are adhered by a method depending on the nature of the adhesive layer 69. When the adhesive is of a two-part set type, the first and second structures E and F are aligned, are pressed to each other by a jig, and are held until setting is completed. When the adhesive is of a thermosetting type, the first and second structures E and F are aligned, are pressed by a jig, and are held in a heating furnace until setting is completed. When the adhesive is of a hot-melt type, the first and second structures E and F are aligned, are pressed by a jig, and are cooled after the resultant structure is heated to a meting temperature of the adhesive or are passed between hot-press rolls.

With the above-mentioned adhesion process, the ion flow controller 60 shown in FIG. 21 is completed.

In a process of applying an adhesive and in a process of adhering the prepared structures, the adhesive may slightly project inside the ion flow passage holes 66A. However, these portions H fall outside principal paths for controlling convergence and passage of an ion flow, as can be seen from FIG. 21. Therefore, such portions do not pose problems as long as they fall within a predetermined limited range.

However, the adhesive may considerably project inside the ion flow passage holes 66A due to an error in an adhesive application process, an alignment error upon adhesion, or the like, and a projection amount may exceed the predetermined limit. This state adversely influences a print image. In this case, after the first and second structures E and F are adhered, an excimer laser beam is radiated through the large-diameter ion flow passage holes 66A from the first electrode 61 side to decompose and remove the projecting adhesive, thus finishing the structure.

Figure 22:
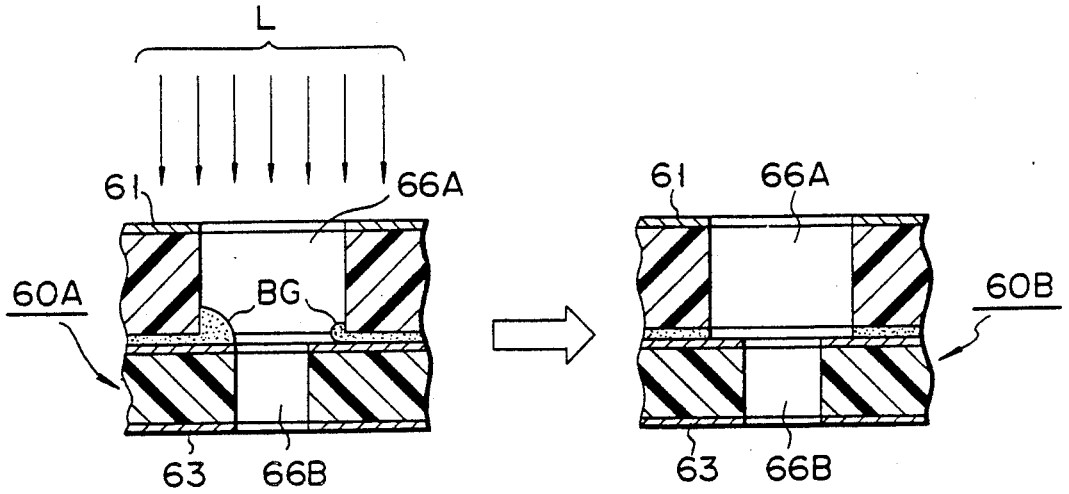

FIG. 22 shows a procedure of the removal operation. As shown in FIG. 22, an excimer laser beam L is radiated through the large-diameter ion flow passage holes 66A from the first electrode 61 side for an ion flow controller 60A in which large adhesive projecting portions BG are formed. Thus, the excimer laser beam L acts on the adhesive projecting portions BG through the ion flow passage holes 66A. For this reason, the adhesive projecting portions BG are photochemically decomposed and removed, thus finishing an ion flow controller 60B as shown in the right illustration.

When the first and second structures E and F are adhered using a hot-melt type adhesive, the adhesive is applied and dried before the through holes are formed in the first insulating layer 64 of the first structure E. When the through holes are simultaneously formed i the insulating layer 64 and the adhesive layer 69, the adhesive can be prevented from projecting into the through holes, resulting in convenience.

Fifth Embodiment

Figure 23:
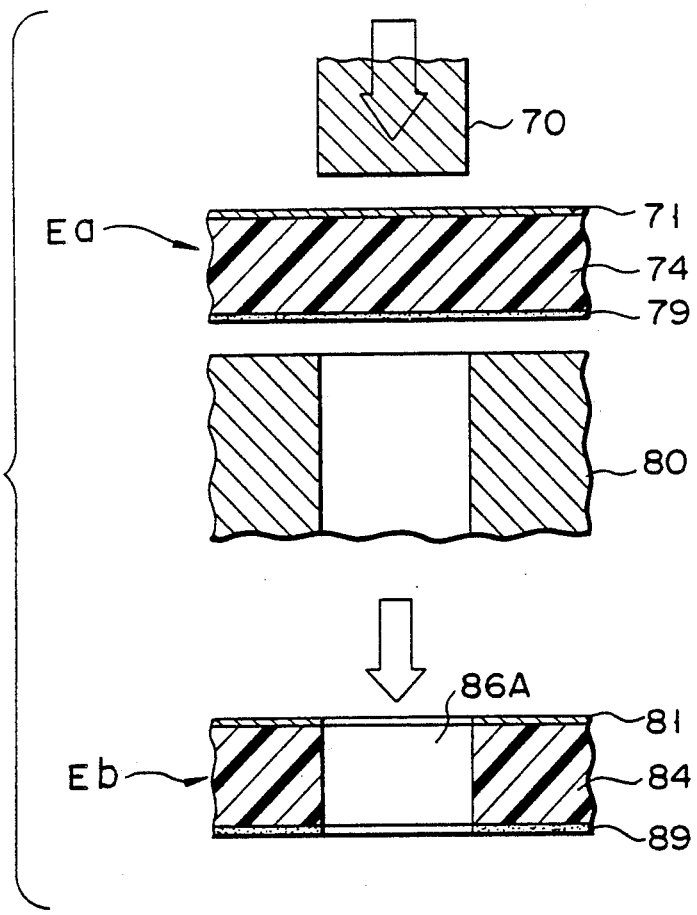
FIG. 23 is a sectional view showing principal steps in a method of manufacturing in ion flow controller according to the fifth embodiment of the present invention.

FIG. 23 shows the fifth embodiment of the present invention in consideration of the above-mentioned respects. In FIG. 23, reference symbol Ea denotes a worked member which comprises a metal layer 71, a high-instating plastic sheet 74, and a hot-melt adhesive layer 79. Reference numeral 70 denotes a punching pin; and 80, a punching dice.

The member Ea is prepared by forming the metal layer 71 on the surface of, e.g., the polyimide high-insulating plastic sheet 74 by adhering a metal foil film or depositing a thin layer by sputtering, and compensating for its thickness by plating. The adhesive layer 79 is formed by coating a material obtained by dissolving a small amount of a low-molecular weight thermoplastic in a solvent, and then evaporating the solvent to dry it. Alternatively, hot-melt adhesive sheets may be stacked, and may be adhered by pressing them by heat rollers.

The member Ea is placed on the punching dice 80, and the punching pin 70 is moved in a direction of an arrow, thus punching the member Ea. As shown in a lower portion of FIG. 23, an ion flow passage hole 86A from which the adhesive is simultaneously removed can be formed. Reference numeral 81 denotes a first electrode; 84, a second insulating layer; and 89, a hot-melt adhesive layer.

A first structure Eb prepared in this manner is aligned and overlaid on a second structure F, and the resultant structure is hot-pressed, as shown in FIG. 20. As a result, the hot-melt adhesive is melted, and the structures are adhered to each other. In this case, almost no adhesive projecting layer BG is present in each ion flow passage hole 86A.

Sixth Embodiment

Figure 24:
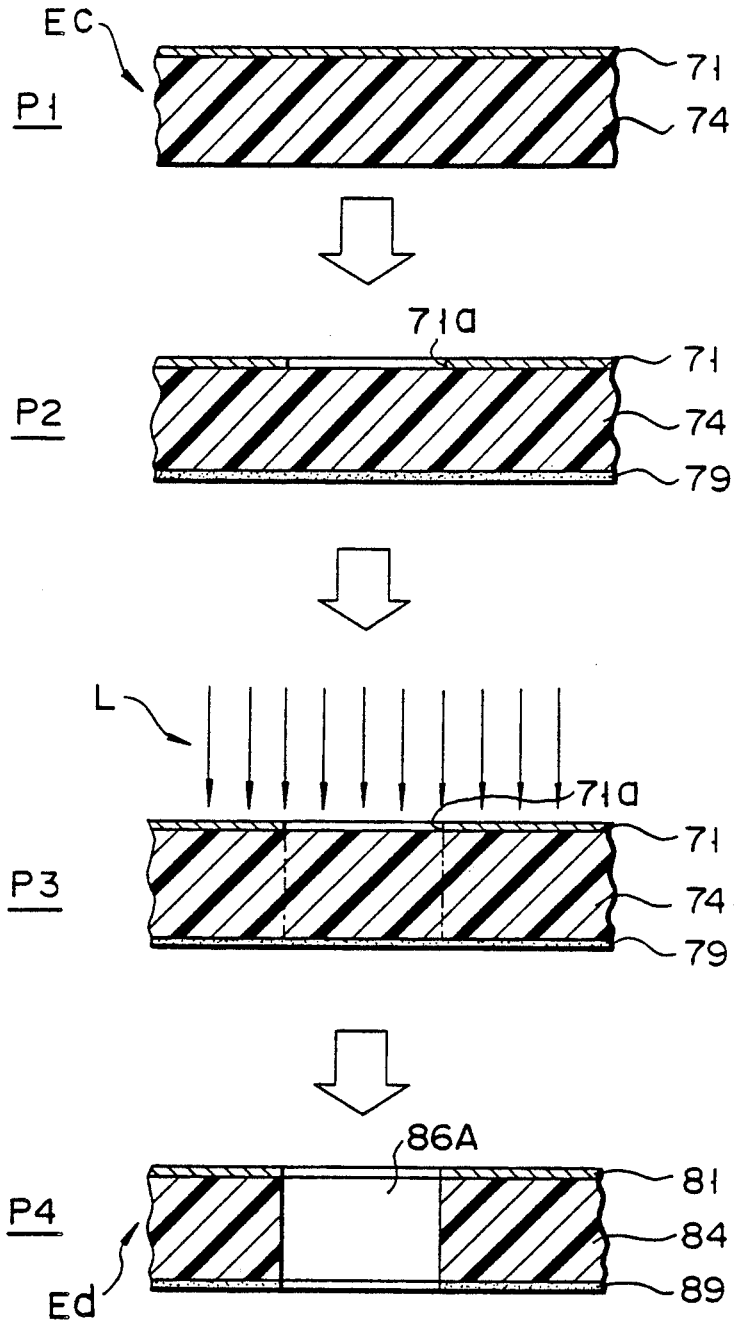
FIG. 24 is a sectional view showing steps in the manufacture of an ion flow controller according to the sixth embodiment of the present invention.

FIG. 24 shows another process example for obtaining the same effect as described above by performing a through hole working process simultaneously in a plastic sheet 74 and a hot-melt adhesive layer 79, i.e., the sixth embodiment of the present invention. In this embodiment, an excimer laser beam is used as a working means for forming ion flow passage holes 86A in a first insulating layer 84. The same reference numerals in FIG. 24 denote the same parts as in FIG. 23. Reference symbol L denotes an excimer laser beam.

Process P1

A member Ec is prepared by integrally forming a metal foil film 71 on, e.g., a polyimide insulating sheet 74. The metal foil film 71 can be adhered by using an adhesive.

Process P2

A photoresist is coated on the metal foil film 71, and a pattern mask for forming ion flow passage holes is overlaid thereon. Ultraviolet rays are radiated on the resultant structure, and non-set resist portions are moved. Thereafter, etching is performed. In this manner, only metal portions of the metal foil film 71 corresponding to the ion flow passage holes are removed, thus forming holes 71*a*. After or before this etching process, a hot-melt adhesive layer 79 is coated on the lower surface of the insulating sheet 74.

Process P3

The excimer laser beam L is radiated from the side of the metal foil film 71 in which the holes 71*a* are formed. Thus, the metal foil film 71 having the holes 71*a* serves as an exposure mask, and the polyimide insulating sheet 74 and the adhesive layer 79 corresponding to portions of the holes 71*a* are photochemically decomposed and removed.

Process P4

In this manner, a first structure Ed constituted by a first electrode 81, the first insulating layer 84, and the adhesive layer 89 comprising large-diameter holes 86A free from adhesive projecting portions therein can be prepared.

In the fourth to sixth embodiments described above, the present invention is applied to an ion flow recording head in which the first electrode facing the ion source comprises a solid electrode. However, the present invention is not limited to this. More specifically, the positions of segment electrodes and a solid electrode can be arbitrarily replaced.

Seventh Embodiment

FIG. 25 and FIGS. 26 to 28 show the seventh embodiment of the present invention. In an ion flow controller 90 of this embodiment, first and third electrodes 91 and 93 are segment electrodes, and a second electrode 92 is a solid electrode. In FIG. 25 and FIGS. 26 to 28, reference numeral 91 denotes the first electrodes as segment electrodes; 94, a first insulating layer; 92, the second electrode as a solid electrode; 95, a second insulating layer; and 93, the third electrodes as segment electrodes.

Figure 25:
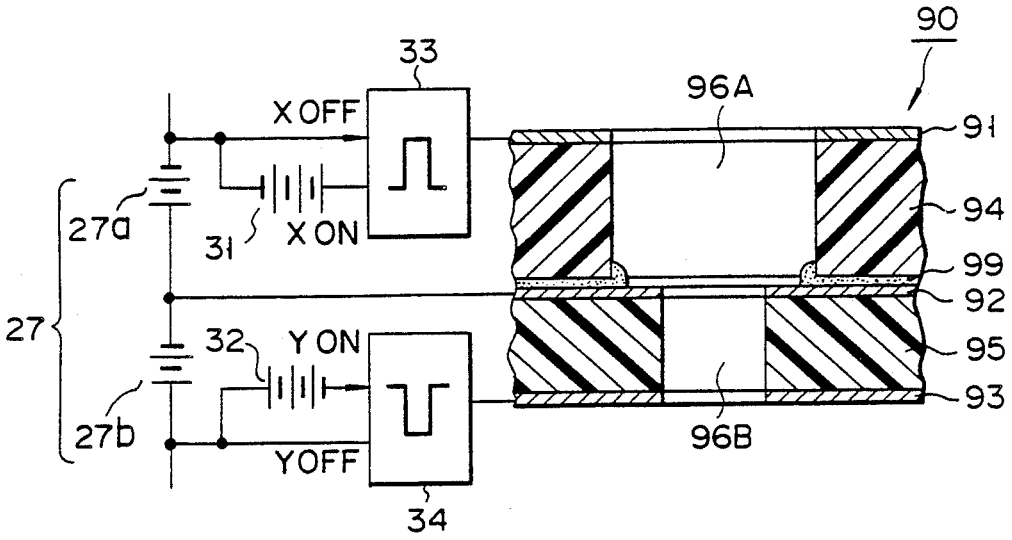
Figure 26:
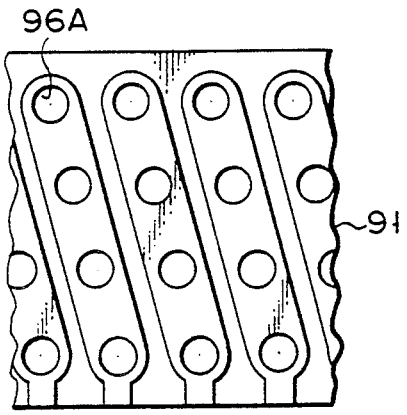
Figure 27:
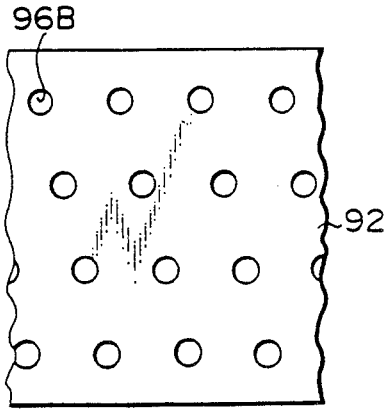
Figure 28:
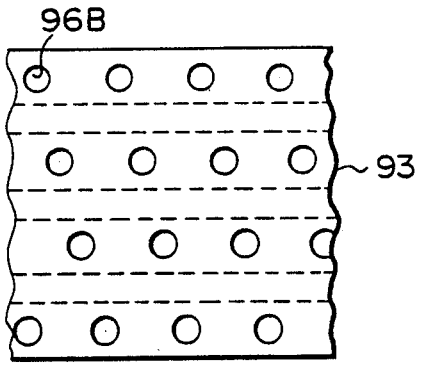

The manufacturing method described above with reference to FIGS. 20 and 21 can be applied to the ion flow controller 90 with the above-mentioned structure. When an excimer laser beam is used as a method of forming ion flow passage holes 96A, a process for segmenting the first electrodes 91 is preferably performed after the ion flow passage holes 96A are formed. When the process for segmenting the electrodes is performed prior to hole formation, insulating sheet portions exposed between the segment electrodes are undesirably decomposed and removed. A drive circuit element shown in FIG. 25 is the same as that shown in FIG. 15. In this embodiment, a signal pulse to be applied to the first electrodes 91 serves to converge an ion flow and to control its passage. An ion flow passage blocking bias power source 27 is divided into two power sources 27*a* and 27*b*.

Additional advantages and modifications will readily occur to those skilled in the art. Therefore, the invention in its broader aspects is not limited to the specific details, and illustrated examples shown and described herein. Accordingly, various modifications may be without departing from the spirit or scope of the general inventive concept as defined by the appended claims and their equivalents.

What is claimed is:

1. A method of manufacturing an ion flow recording head, comprising the steps of:

preparing a first member comprising a multilayered structure of a first electrode, a first insulating layer, and a second-A electrode, and having first ion flow passage holes;

preparing a second member comprising a multilayered structure of a second-B electrode, a second insulating layer, and a third electrode, and having second ion flow passage holes; and integrating said first and second members by adhering said second-A and second-B electrodes to constitute an ion flow controller.

2. A method according to claim 1, wherein an excimer laser beam is radiated on said first and second members using said second-A and second-B electrodes as exposure masks, respectively, so that the ion flow passage holes are formed in said first and second members.

3. A method according to claim 1, wherein the ion flow passage holes in said first member are formed to have a diameter equal to or larger than a diameter of the ion flow passage holes formed in said second member.

4. A method according to claim 1, wherein a diameter of the ion flow passage holes formed in said first insulating layer and said second-A electrode of said first member is larger than a diameter of the ion flow passage holes formed in said first electrode.

5. A method according to claim 4, wherein the ion flow passage holes in said first insulating layer and said second-A electrode of said first member are formed as an elongated opening portion having a size large enough to include a plurality of unit pixel ion flow passage holes.

6. A method of manufacturing an ion flow recording head, comprising the steps of:

preparing a first structure comprising a multilayered structure of a first electrode and a first insulating layer, and having an adhesion layer formed on a surface of said first insulating layer and first ion flow passage holes;

preparing a second structure comprising a multilayered structure of a second electrode, a second insulating layer, and a third electrode, and having second ion flow passage holes; and integrating said first and second structures by adhering said first insulating layer and said second electrode through said adhesion layer to constitute an ion flow controller.

7. A method according to claim 6, wherein after a hot-melt adhesive is coated on said first insulating layer and is dried, the ion flow passage holes are simultaneously formed to extend through said first insulating layer and said hot-melt adhesive layer, thereby forming said first structure.

8. A method according to claim 6, wherein after said first electrode, said first insulating layer, and said adhesion layer are integrated and holes are formed in said first electrode, an excimer laser beam is radiated on a resultant structure from a side of said first electrode, thereby forming the ion flow passage holes to extend through said first insulating layer and said adhesion layer.

* * * * *